United States Patent [19]

Beck

[11] 4,033,715

[45] July 5, 1977

[54] HEAT PROCESSING SYSTEM

[75] Inventor: Jacob Howard Beck, Waban, Mass.

[73] Assignee: BTU Engineering Corporation, North Billerica, Mass.

[22] Filed: Jan. 12, 1976

[21] Appl. No.: 648,538

[52] U.S. Cl. ..... 432/4; 432/5; 432/121; 432/124; 432/128; 432/153

[51] Int. Cl.² ..... F27D 3/06

[58] Field of Search ..... 432/1, 3, 4, 5, 153, 432/136, 154, 128, 121–124, 135, 140; 34/236

[56] References Cited

UNITED STATES PATENTS

| | | | |
|---|---|---|---|
| 1,280,205 | 10/1918 | Garza | 432/124 |
| 1,434,036 | 10/1922 | Ballard | 432/121 |
| 1,599,594 | 9/1926 | Sockman | 432/124 |
| 1,858,937 | 5/1932 | Pointon | 432/121 |

*Primary Examiner*—John J. Camby
*Assistant Examiner*—Henry C. Yuen
*Attorney, Agent, or Firm*—Weingarten, Maxham & Schurgin

[57] ABSTRACT

A heat processing system in which a product is efficiently conveyed through a high temperature furnace and in which the product can be stored within a section of the furnace at a temperature less than the critical temperature to which product exposure must be limited. The furnace includes multiple sections each of a respective operating temperature, one of the sections being of high temperature to which a product can be exposed for only a limited time. A supply of product carriers is contained within the furnace onto which a product is supplied for transport forwardly through the furnace for unloading at an opposite end thereof, the carriers being returned rearwardly through the furnace back to a loading area. During an emergency mode of operation, loading of the product is discontinued and the product already within the furnace is transferred from the critical heat section to an adjacent section for storage at a lower temperature less than the high critical temperature.

4 Claims, 7 Drawing Figures

HEAT PROCESSING SYSTEM

FIELD OF THE INVENTION

This invention relates to furnaces and more particularly to high temperature precision furnaces for the heat processing of products and materials.

BACKGROUND OF THE INVENTION

In the heat processing of a product, the product after conveyance through a furnace is often next transferred to a work station for pressing, forging or other intended operation. If a failure of the work station occurs, the heated product leaving the furnace must again be heated once the work station is again operative or the furnace conveyor must be stopped to retain the product in a heated condition within the furnace during stoppage of the work station. In many instances, however, and especially in the extremely high temperature processing of products and materials, there is a time limit to product exposure to the high furnace temperature beyond which deterioration or damage to the product can result. In such cases, the product must be removed from the furnance and later reheated which, of course, requires additional time and energy to raise the product to the operating temperature. Moreover, in some instances a product cannot be removed from the furnace and reheated without deterioration of the product.

SUMMARY OF THE INVENTION

Briefly, the present invention provides a heat processing system in which a product is efficiently conveyed through a high temperature furnace and in which the product can be stored in a furnace section having a temperature less than a critical temperature to which product exposure time is limited. In a preferred embodiment, the novel system includes an elongated furnace having disposed sequentially along the length thereof a preheat section, a high temperature processing section and a lower temperature holding section. Conveyor apparatus is provided in each section of the furnace and a supply of product carriers is disposed on the conveyor apparatus on which a product is loaded at a loading end of the furnace for transport through the furnace sections to an unloading end at which the product is unloaded for movement to a subsequent work station. After product unloading, the carriers are returned via the conveyor apparatus through the furnace to the loading area for reloading of a product. In the event of failure of the work station to which the product is being moved upon unloading from the furnace, the novel system is operative in an emergency mode wherein delivery of a product to the furnace is discontinued and the product on the conveying apparatus within the high heat section is automatically transferred to the lower temperature holding section in which the product is retained throughout the emergency interval. During an emergency condition the product is not exposed to the critical high temperature but rather is safely maintained at a lower noncritical temperature at which no material degradation of the product occurs. During resumption of normal operation, the product stored in the holding section is cycled through the furnace for subsequent unloading and transport to the work station.

DESCRIPTION OF THE DRAWINGS

The invention will be more fully understood from the following detailed description taken in conjunction with the accompanying drawings in which.

DETAILED DESCRIPTION OF THE INVENTION

Figure 1:
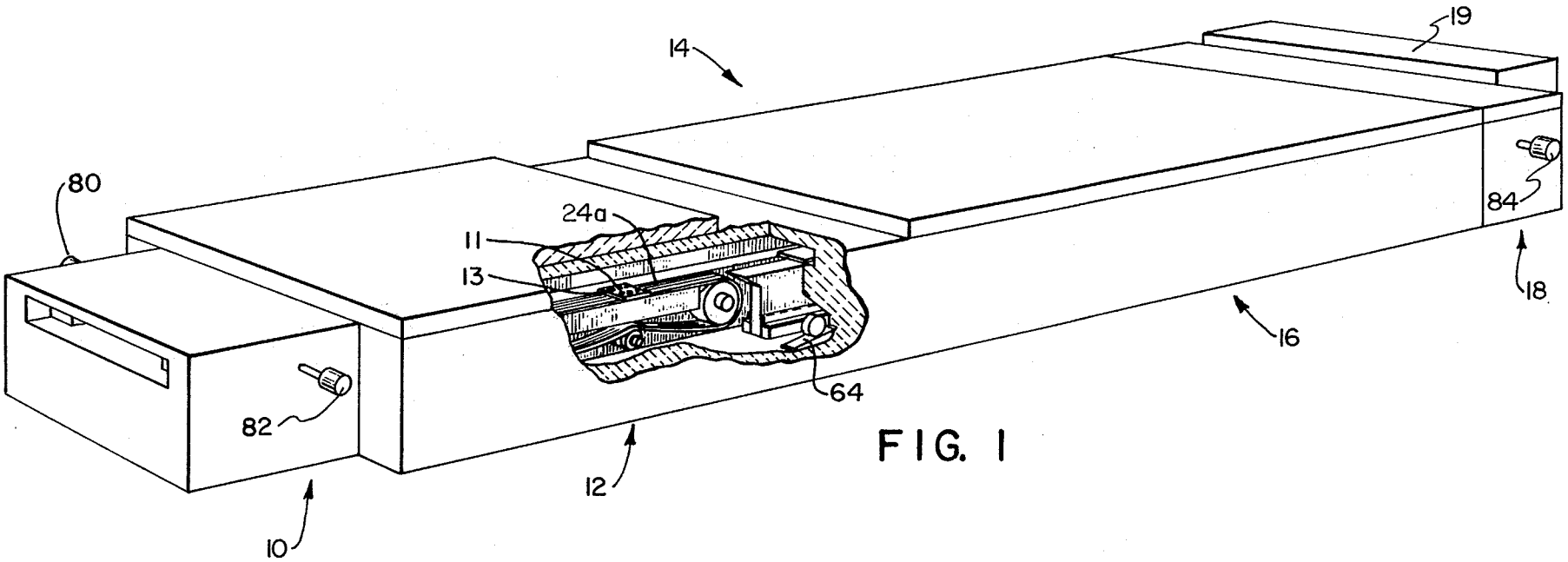
FIG. 1 is a partially cutaway pictorial view of a heat processing system according to the invention.
Figure 3:
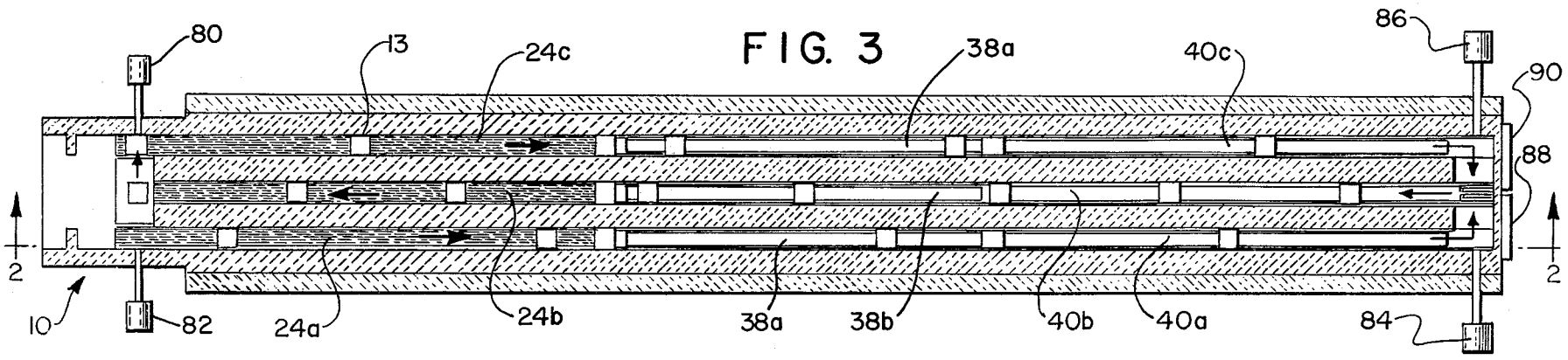
FIG. 3 is a sectional top view of the embodiment of FIG. 1.
Figure 2:
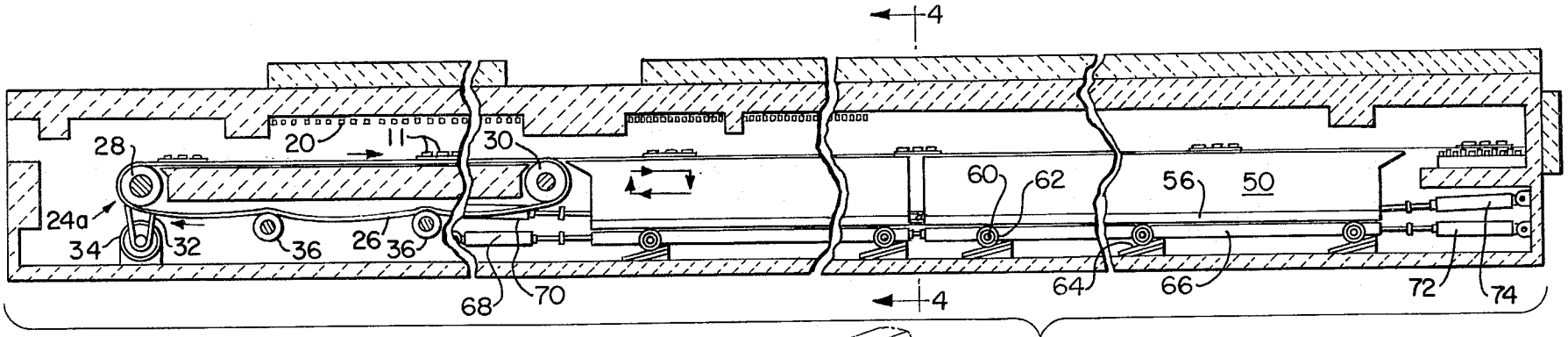
FIG. 2 is a sectional elevation view of the embodiment of FIG. 1.

Referring to FIGS. 1–3, there is shown a heat processing system according to the invention and comprising a loading area 10 at which a work product 11 is introduced onto product carriers 13 for transport into a preheat section 12 which is contiguous with a high temperature processing section 14, in turn contiguous with a holding section 16 which terminates in an unloading area 18 from which the product is removed to a subsequent work station 19 for further processing as required. The sections 12, 14 and 16 include a continuous furnace chamber which extends longitudinally through the furnace between loading area 10 and unloading area 18. The furnace chamber is defined by a high temperaure refractory material, typically in the form of firebrick and containing heating elements 20 in the respective sections to heat the chambers of the respective sections to intended temperatures. A heat barrier (not shown) can be provided between sections 14 and 16 to maintain a predetermined temperature profile between the adjacent sections. Details of the furnace insulation and heating elements are not pertinent to the present invention and are only generally shown. The heat barrier is of known construction, a preferred example being that shown in U.S. Pat. No. 3,041,056, assigned to the same assignee of this invention. The mechanism for loading and unloading a product in areas 10 and 18 are also of well known configuration and operation and need not be described in any detail herein.

The preheat section 12 includes three roller chain conveyors **24*a*, 24*b* and 24*c* disposed in parallel arrangement across the width of the furnace and extending throughout the length of this section 12, with the upper surfaces of the chain conveyors being disposed at the hearth surface for the transport of a product through this section. As best seen in FIG. 2, each of the chain conveyors includes an endless chain or mesh conveyor belt 26 disposed around end rollers 28 and 30, the forward roller being coupled such as by a sprocket chain 32 to a drive motor 34. One or more rollers 36 can be provided to support the lower returning portion of belt 26 during its closed loop travel. The outer chain conveyors 24*a* and 24*c* are movable in a forward direction from loading area 10 toward processing section 14. The center chain conveyor 24*b* is movable in a reverse direction from section 14 to area 10 and at a speed of travel twice that of outer conveyors 24***a* and 24*c* during normal furnace operation, as will be further described below.

The heat processing section 14 and holding section 16 each contain three movable hearth or walking beam type conveyors disposed in parallel arrangement across the width of the respective sections and extending longitudinally therethrough. Section 14 contains conveyors 38*a*, 38*b* and 38*c*, while section 16 contains conveyors 40*a*, 40*b* and 40*c*. Each longitudinally disposed conveyor is in alignment with the corresponding conveyor of an adjacent section to provide three longitudinal parallel travel paths through the entire furnace.

Figure 4:
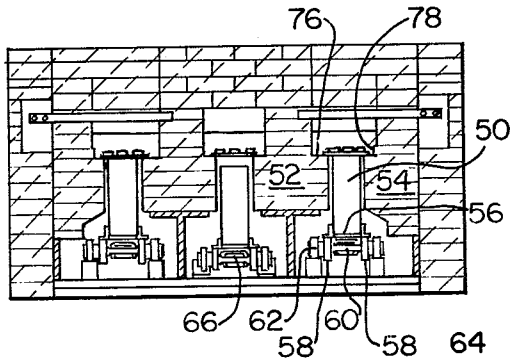
FIG. 4 is a sectional end view taken along lines 4—4 of FIG. 2.

The movable hearth conveyor is itself preferably of the type shown in U.S. Pat. No. 3,633,855, assigned to the assignee of this invention. Each of the movable hearth conveyors of section 14 and 16 is operative to provide consistent and precise cyclic movement of the furnace hearth to achieve stepwise transport of a work product through the furnace. Referring to FIGS. 2 and 4, each of the movable hearth conveyors includes an elongated support member 50 formed of a high temperature ceramic such as alumina and movably supported between side members 52 and 54. The member 50 includes an upper surface which forms part of the furnace hearth and is supported by an elongated structural member 56 horizontally disposed along the length of the associated furnace section and below the furnace chamber. This member 56 is supported by a plurality of rollers 58 arranged in pairs along the length of member 50, each pair being rotatably disposed on a shaft 60.

A second plurality of rollers 62 are rotatably disposed in pairs on shafts 60, each roller 62 being cooperative with a respective inclined plane 64 disposed along the length of the furnace sections on respective opposite sides of the support member 50. The shafts 60 are attached to a channel member 66.

Cyclic motion is imparted to the members 50 by hydraulic cylinders or other motive means disposed at one or both ends of the furnace sections. In the illustrated embodiment a pair of hydraulic actuators are coupled to each movable hearth conveyor of sections 14 and 16. As shown in FIG. 2, hydraulic actuators 68 and 70 are respectively coupled to members 66 and 56 of the illustrated conveyor in section 14. Like actuators are similarly coupled to the other two conveyors of this section. In like manner, actuators 72 and 74 are respectively connected to members 66 and 56 of the illustrated conveyor in section 16, like actuators also being connected to the other two conveyors of section 16. Channel member 66 is movable, in response to a driving force by the associated actuator, by means of rollers 62 upon inclined planes 64 causing corresponding movement of member 50. In response to the associated actuator, member 56 is then movable on rollers 58 to provide lateral movement of member 50. By sequential operation of the actuators the hearth member 50 of each conveyor is cyclically moved to provide stepwise transport of the product or product carrier along the movable hearth and through the associated furnace section.

In its uppermost position, member 50 is disposed with its upper surface above shoulder portions 76 and 78 to raise the product carriers supported thereon off the shoulders. The carriers are laterally moved in this raised position to a position forwardly of their former position. In its lowermost position, member 50 is moved to its initial position for commencement of another cycle of operation. The operation of the movable hearth conveyors themselves is well known in the art and is described in detail in the aforesaid U.S. Pat. No. 3,633,885.

The outer movable hearth conveyors 38*a* and 38*c* of section 14 are operative to transport a product in a forward direction from section 12 to section 16, while the outer conveyors 40*a* and 40*c* of section 16 are operative to transport a product forwardly from section 14 to unloading area 18. The center conveyor 38*b* of section 16 operates in an opposite direction from the associated outer conveyors to transport product carriers from unloading area 18 through section 16 to section 14. The center conveyor 40*b* of section 14 also operates in this reverse direction to transport product carriers from section 16 to section 12. The center conveyors 38*b* and 40*b* operate at twice the speed of the outer conveyors 24*a* and 24*c* and 38*a* and 38*c* during usual furnace operation. In addition, the outer conveyors 40*a* and 40*c* of section 16 operate at twice the speed of the outer conveyors 38*a* and 38*c* of section 14 during usual furnace operation.

The furnace system contains a plurality of product carriers 13 which may be of any convenient form to accommodate a particular product being processed and which may typically be a flat rectangular plate or tray on which a product is conveyed through the furnace and made of a suitable material compatible with the particular product being processed and the operating temperatures employed. Empty carriers being returned to loading area 10 along the center conveyors are laterally moved in an alternate manner to the outer conveyors 24*a* and 24*c* of section 12. A product is supplied to the returned carriers at a convenient time before the carriers commence their movement through section 12. The transfer mechanism at the loading area 10 typically includes laterally movable push rods 80 and 82 for transferring the carriers on the center conveyor 24*b* alternately to the outer conveyors 24*a* and 24*c*. Thus, a carrier 13 returned to area 10 along the center conveyor 24*b* is transferred by push rod 80 to outer conveyor 24*a*, while the next returning carrier is transferred by push rod 82 to outer conveyor 24*c*, the transfer operation continuing in like manner for each returning carrier.

Figure 5:
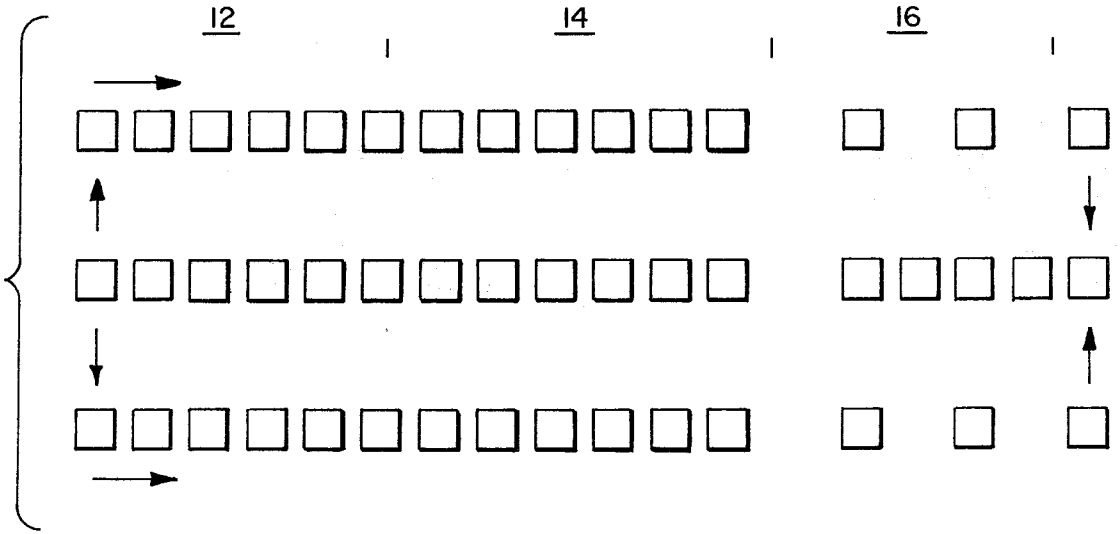
FIG. 5 is a diagrammatic view of the product carrier arrangement within the furnace during normal operation.

The carriers containing the product are conveyed through section 12 by chain conveyors 24*a* and 24*c* and thence by conveyors 38*a* and 38*c* through section 14. The product carriers in their travel through these sections 12 and 14 are single spaced as shown in FIG. 5. In the holding section 16, the outer conveyors 40*a* and 40*c* operate at twice the speed of the outer conveyors of section 14, such that the carriers are double spaced during their travel through section 16 as shown in FIG. 5. Each carrier is followed by an empty space equal to the size of the carrier and thus half the available space on the conveyor is empty. When each product-containing carrier arrives at unloading area 18, the product is removed by a suitable unloading mechanism for conveyance to the subsequent work station. The carriers from which the product has been removed are then alternately transferred by a suitable lateral transfer mechanism such as push rods 84 and 86, to the center conveyor 40*b* for transport back through the furnace to the loading area 10. Each carrier 13 arriving at area 18 on conveyor 40*b* is transferred by push rod 84 to center conveyor 40*b*. Each carrier on conveyor 40*c* arriving at area 18 is transferred by push rod 86 to conveyor 40*b*.

Figure 7:
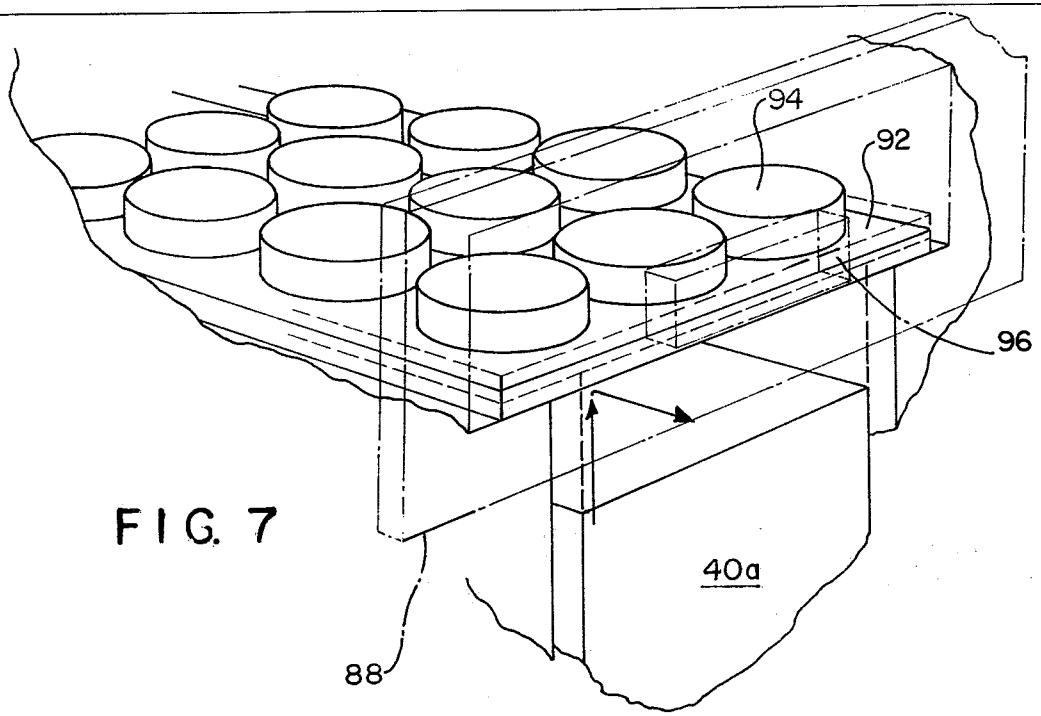
FIG. 7 is a diagrammatic representation of a scanning exit door employed in the invention.

In order to maintain the high temperature environment of the furnace, one or more doors are provided at the unloading end of the furnace to minimize heat loss therefrom. Typically, two doors 88 and 90 are provided, each associated with a respective one of the outer conveyors of section 16. Each door includes a slot corresponding to the size of the product being unloaded from the product carriers for conveyance to the work station 19. The slot in the door is also sufficient to accommodate the unloading mechanism. Each door is moved laterally across the furnace width to scan the slot between successive lateral positions at which a product is to be unloaded. For example, for the product arrangement shown in FIG. 7 wherein a product carrier 92 contains three products 94 across the width thereof, door 88 includes an opening 96 sufficient to unload each of the products, the door opening being laterally scanned to successive positions for the removal of each of the three laterally disposed products 94. The particular scanner door arrangement can suit the particular product being unloaded and the degree of heat shielding required. The drive apparatus for the doors can be of any well known form to provide stepwise or continuous lateral movement.

The furnace contains a predetermined supply of carriers which are moved with products thereon through the furnace on the outer conveyors and returned empty along the center conveyors to the loading area. During normal operation wherein product carriers are loaded with a product at the loading area and the products arriving at the unloading area on the outer conveyors are unloaded, the carriers are disposed as shown in FIG. 5.

Figure 6:
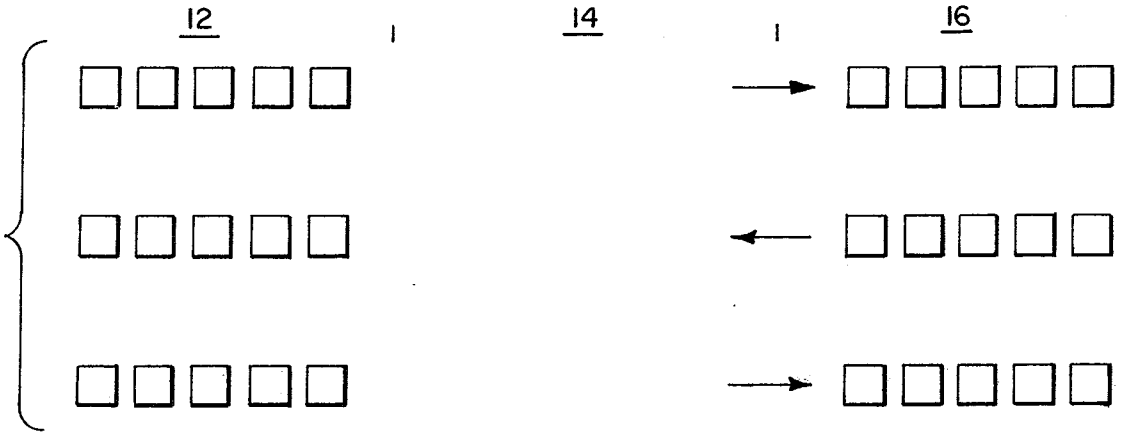
FIG. 6 is a diagrammatic view of the product carrier arrangement within the furnace during the emergency mode.

If, however, a failure in work station 19 or other event prevents the unloading of the product from the furnace, the novel system is operative in an emergency mode to store and preserve the product within the furnace. In this emergency mode of operation, product loading onto the carriers in area 10 is discontinued and the chain conveyors 24*a*–24*c* are stopped. The product carriers on conveyor 24*b* in preheat section 12 are empty, while the loaded product carriers on the outer conveyors 24*a* and 24*c* remain stopped in the preheat section 12. The product carriers containing the heated product transported by outer conveyors 40*a* and 40*c* in section 16 are transferred to the center conveyor 40*b* upon the completion of which the speed of outer conveyor 40*a* and 40*c* is reduced to half their normal speed, such that the product being moved from conveyors 38*a* and 38*c* onto associated conveyors 40*a* and 40*c* is in single spaced arrangement, as shown in FIG. 6. After the transport of the product onto conveyors 40*a* and 40*c*, all movable hearth conveyors are stopped. The product is held only in preheat section 12 and holding section 16, the high heat processing section 14 containing no product during the emergency mode. The product is thus stored in the furnace at temperatures below the degradation level of the product and the product is not exposed during the emergency storage time to the damaging high temperature of section 14.

In order to restart normal operation, the high heat section 14 is lowered in temperature to a level below the critical temperature for the particular product so that the product being returned through this section along the center conveyor 38*b* will not be exposed to the high heat during this return travel interval. Section 14 is thereafter returned to its high normal temperature and the conveyors again operated at normal speed to provide transport of the product through the furnace and return of product carriers to the loading area.

In a typical embodiment for the processing of powder metal products, the preheat section 10 is operated at a temperature of 1000° F, processing section 12 at a temperature of 2250° F and holding section 16 at a temperature of 1800° F. A product typically moves through the furnace at an average speed of one foot per minute, although the effective speed will vary depending upon the characteristics of the material and the particular heat processing procedure being accomplished.

The invention is not to be limited by what has been particularly shown and described, as various modifications will occur to those versed in the art without departing from the true scope of the invention.

What is claimed is:

1. For use in a furnace having a high heat section to which exposure of a product must be limited, a lower temperature section contiguous with said high heat section for passage of a product along a common axis through said high heat section and said lower temperature section, first conveyor apparatus in said high heat section for transporting a product in a forward direction therethrough, second conveyor apparatus in said high heat section for transporting product carriers in a reverse direction therethrough, third conveyor apparatus in said lower temperature section for transporting a product in a forward direction through the lower temperature section and fourth conveyor apparatus in the lower temperature section for transporting product carriers in a reverse direction through the lower temperature section, and means for transferring the product carriers on the third conveyor apparatus at the end of the lower temperature section to the associated end of the fourth conveyor apparatus of the lower temperature section, a method for safely storing a product in a furnace during an emergency condition comprising the steps of:

moving a product on the third conveyor apparatus of the lower temperature section to the fourth conveyor apparatus of the lower temperature section;

moving the product on the first conveyor apparatus of the high heat section to the third conveyor apparatus of the lower temperature section; and stopping said conveyor apparatus to retain said product in the furnace only within the lower temperature section.

2. The method of claim 1 further including the step of:

lowering the temperature of said high heat section during a restarting interval such that transport of the product in a reverse direction through the high heat section will occur at a temperature below the limited exposure temperature.

3. For use in a furnace having sequentially disposed along the length thereof:

a preheat section having forward conveyor apparatus for transport of a product therethrough in a forward direction and rearward conveyor apparatus for transport of product carriers therethrough in a reverse direction;

a high heat section to which exposure of a product must be limited and disposed contiguous with said preheat section and having forward conveyor apparatus for transport of a product through the high heat section in a forward direction and rearward conveyor apparatus for transport of product carriers through the high heat section in a reverse direction;

a lower temperature holding section contiguous with the high heat section and having forward conveyor apparatus for transport of a product through the holding section in a foward direction and rearward conveyor apparatus for transport of product carriers through the holding section in a reverse direction;

means for transferring the product carriers on the forward conveyor apparatus at the end of said holding section to the associated end of the rearward conveyor apparatus of said holding section;

a method for storing a product in the furnace during an emergency condition comprising the steps of:

stopping said forward conveyor apparatus in said preheat section to retain a quantity of products within this section;

moving the products on the forward conveyor apparatus of said holding section to the rearward conveyor apparatus of said holding section;

moving the products on the forward conveyor apparatus of said high heat section to the forward conveyor apparatus of said holding section; and stopping said conveyor apparatus of said holding section to retain the products within this section, with no products being contained within said high heat section during the emergency interval.

4. For use in a furnace having sequentially disposed along the length thereof:

a preheat section, a high heat section to which exposure of a product must be limited and disposed contiguous with said preheat section, and a lower temperature holding section contiguous with said high heat section;

said sections being disposed along a common axis for passage of a product successively therethrough;

first and second conveyor means in each of said sections for transporting a product in a forward direction through respective sections;

third conveyor means in each of said sections for transporting product carriers in a reverse direction through respective sections;

means for alternately transferring product carriers on the first and second conveyor means at the end of said holding section to the associated end of the third conveyor means of said holding section;

a method for storing a product in a furnace during an emergency condition comprising the steps of:

operating the first and second conveyor means of said preheat section and said high heat section at a first speed during normal conditions;

operating the first and second conveyor means of said holding section at twice the speed of said first speed during normal conditions such that product carriers in said holding section are double spaced on the first and second conveyor means therein;

operating the third conveyor means of each of said sections at twice the speed of said first speed during normal conditions;

stopping the first and second conveyor means of said preheat section during an emergency condition to retain a quantitiy of products within this section;

moving the products on the first and second conveyor means of said holding section to the third conveyor means of said holding section and upon completion of such movement reducing the speed of the first and second conveyor means of said holding section to said first speed;

moving the products on the first and second conveyor means of said high heat section to the first and second conveyor means of said holding section; and after completing product movement into said holding section stopping the conveyor means of said holding section to retain the products within this section, with no products being contained within said high heat section during the emergency condition.

* * * * *

UNITED STATES PATENT AND TRADEMARK OFFICE

CERTIFICATE OF CORRECTION

PATENT NO. : 4,033,715

DATED : July 5, 1977

INVENTOR(S) : Jacob Howard Beck

It is certified that error appears in the above-identified patent and that said Letters Patent are hereby corrected as shown below:

Column 1, line 24, "furnance" should read --furnace--.
Column 3, line 16, "3,633,855" should read --3,633,885--.
Column 8, line 26, "quantitiy" should read --quantity--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*